United States Patent [19]

Gleich

[11] Patent Number: 4,475,626

[45] Date of Patent: Oct. 9, 1984

[54] SCAFFOLD BRACKET

[76] Inventor: Jerome E. Gleich, 3094 Coney Island Ave., Brooklyn, N.Y. 11235

[21] Appl. No.: 410,135

[22] Filed: Aug. 20, 1982

[51] Int. Cl.[3] ..... E04G 3/06

[52] U.S. Cl. ..... 182/150; 182/55; 248/208; 248/242

[58] Field of Search ..... 182/150, 206, 54–62; 248/188.4, 208, 236, 235, 217.2, 242

[56] References Cited

U.S. PATENT DOCUMENTS

| | | | |
|---|---|---|---|
| 957,324 | 5/1910 | Gall | 182/150 |
| 1,166,118 | 12/1915 | Faragher | 182/62 |
| 2,564,935 | 8/1951 | Templeton | 248/242 |
| 2,849,257 | 8/1958 | Woyton | 182/55 |

*Primary Examiner*—Reinaldo P. Machado

*Attorney, Agent, or Firm*—Richard L. Miller

[57] ABSTRACT

A hook device for hanging outside of a building window opening for supporting one end of a scaffold plank, the device being shaped with a hook at one end and a loop at its other end and also including a steadying cross brace fitted with bolts to abut the building wall face.

2 Claims, 4 Drawing Figures

SCAFFOLD BRACKET

This invention relates generally to suspended scaffolds. More specifically it relates to hooks from which suspended scaffolds are supported.

BACKGROUND OF THE INVENTION

It is well known that suspended scaffolds for use alongside the face of a building are generally hung at this time from supports attached to the building roof and the scaffold is then lowered to any desired elevation alongside the building face. Such scaffolding, requiring long ropes to reach lower areas of the building face, uses substantially strong and heavy equipment which requires several workmen to set up and operate.

SUMMARY OF THE INVENTION

It is a principal object of the present invention to provide a sky hook which is more practical for small jobs alongside a building face and which permits a scaffold to be hung from the building windows so as to eliminate suspension from the roof and its long ropes and heavier equipment.

Another object is to provide a sky hook which can be quickly set up and used by a single workman and which is more safe than a rope suspended scaffold.

Yet another object is to provide sky hook that would be particularly ideal for a workman alongside a building face when working on a wall or window structure, or for use as a platform when lifting any heavy equipment such as a boiler or a piano that cannot fit in the building elevator but can be passed through a window.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

DETAILED DESCRIPTION OF PREFERRED FORM

Figure 1:
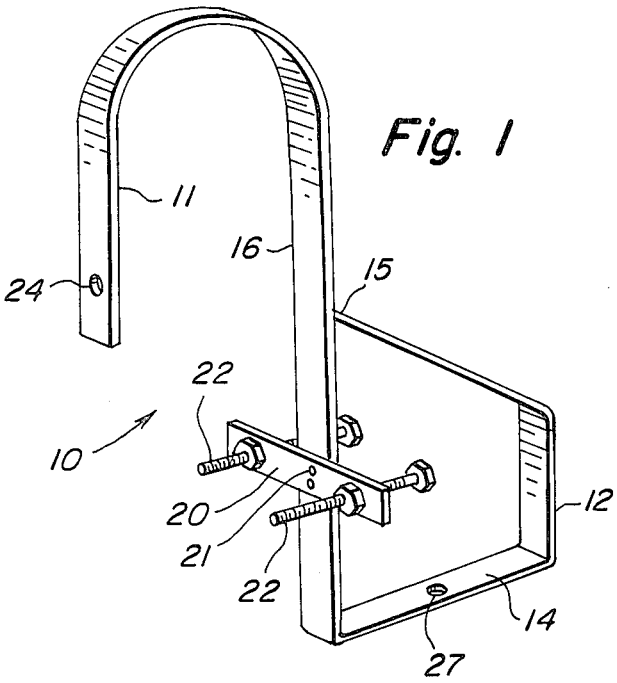
FIG. 1 is a perspective view of the invention.
Figure 2:
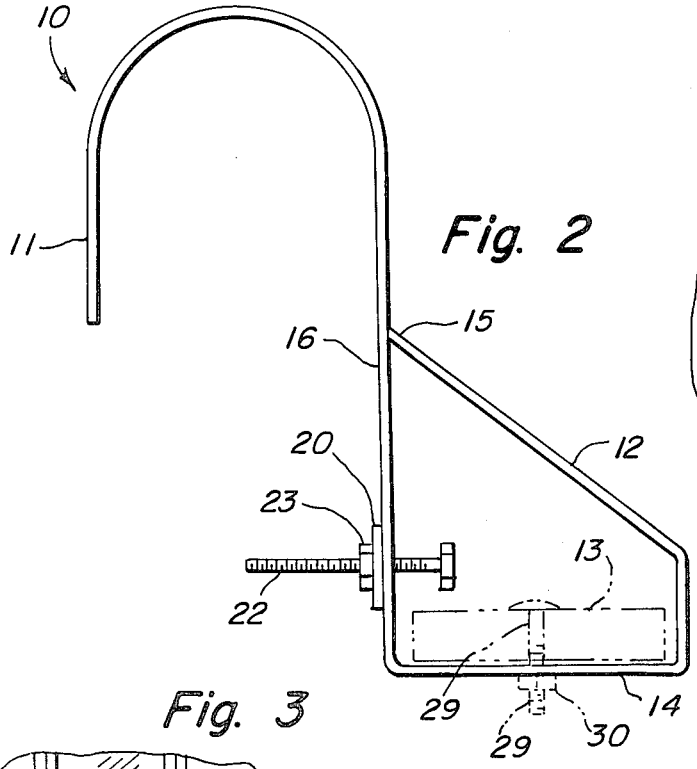
FIG. 2 is a side elevation view thereof.

Referring now to the drawing in greater detail, the reference numeral 10 represents a sky hook according to the present invention and which is made from a very strong material, preferably a tough steel strap or forged steel or both, so as to support a heavy load without breaking or bending and which may be made in any of the various sizes to suit all situations.

It includes an inverted U-shaped hook 11 formed at one end and a loop 12 formed at its opposite end for a scaffold plank 13 to be fitted therethrough, the loop having a straight horizontal portion 14 upon which the plank rests and an end 15 of the loop being permanently and strongly affixed to a vertical leg portion 16 formed between the hook and the loop. The hook serves for being hooked over the window ledge 17 of a window opening 18 of a building wall 19.

In order to steady the sky hook against the building wall when the sky hook is hung outside of the window, a horizontal cross-brace 20 is pivotally, permanently secured to the leg portion 16 by means of rivets 21 which are flared over at their ends but fit with sufficent slop in their respective holes, and are of a proper length so as to permit limited rotational movement of the cross brace about the axis of leg portion 16. This accommodates for irregularities in the building wall against which the sky hook is installed. An adjustable bolt 22 mates with threads in each opposite end of the cross-brace, serving to abut against the building face, so as to give a total of three point securement of the sky hook when in its installed position. As shown in FIG. 1, one of the bolts is farther than the other bolt from the rivets so as to provide a fine adjustment for the installation. Since it is further away from the rivet, threading of this bolt causes less movement of the leg portion 16. The other bolt, being closer to the rivet, causes greater movement of the leg portion 16 as it is threaded and is therefore used for course adjustment. A locknut 23 if fitted on each bolt so that when adjusted the position of the bolt can not be prevented from acidentally changing.

A hole 24 through the bent over end of the hook 11 may be used to receive a rope 25 tied thereto, the rope being tied to any strongly stationary object inside the building, so as to insure against accidental unlocking of the hook 11 from the window ledge.

Figure 3:
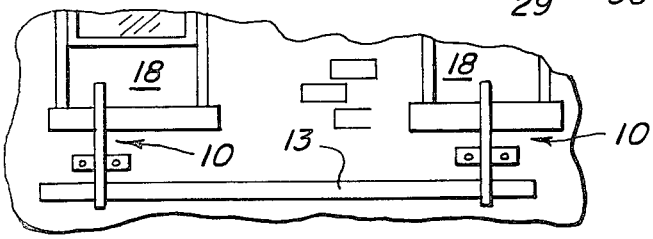
FIG. 3 is a front edge view of a pair of sky hooks, shown hanging outside of two windows of a building and supporting a plank therebetween.
Figure 4:
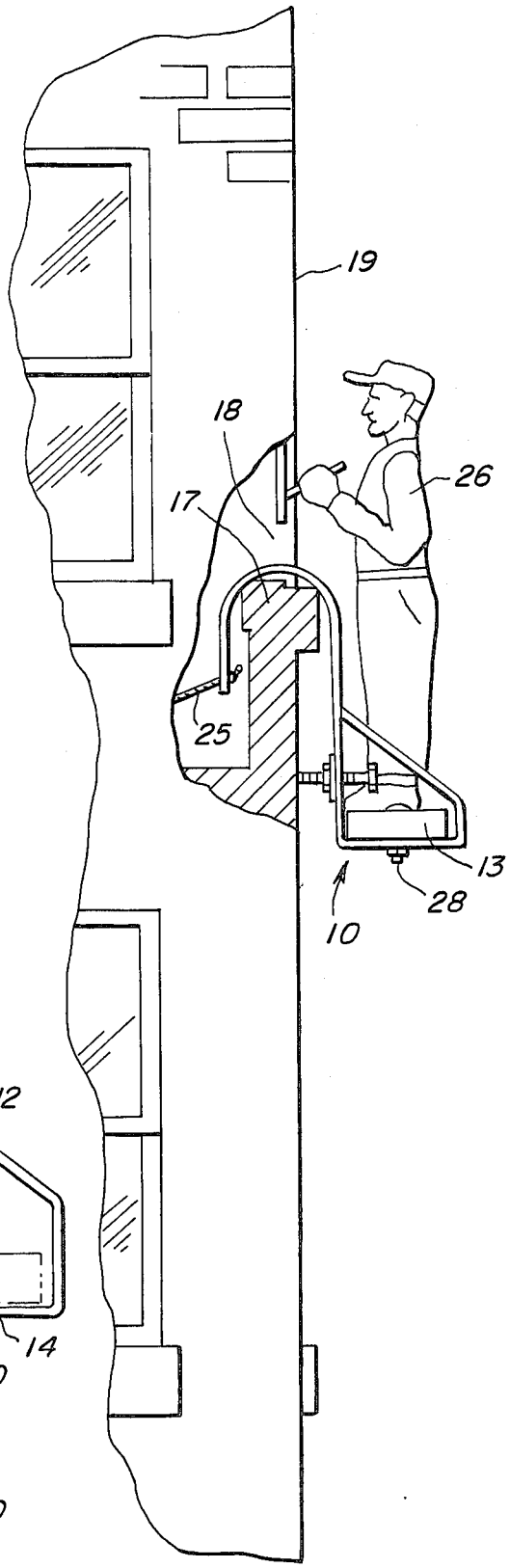
FIG. 4 is a said elevation view thereof, showing a workman supported on the plank installed onto the two sky hooks.

In operative use, as shown in FIG. 3, a pair of sky hooks are used so as to support opposite ends of the plank upon which a workman 26 stands. Another rope or strap (not shown) may be secured around the workman's waist and is also attached to a strongly stationary object so as to prevent the workman from accidentally falling off of the plank.

A hole 27 through the straight portion 14 of the loop serves to receive a bolt 28 dropped through a hole 29 in the plank, the bolt being fitted with a nut 30. The bolt prevents the end of the plank from accidentally slipping out of the loop.

While certain novel features of this invention have been shown and described and are pointed out in the annexed claims, it will be understood that various omissions, substitutions and changes in the forms and details of the device illustrated and in its operation can be made by those skilled in the art with out departing from the spirit of the invention.

What is claimed is:

1. A sky hook for supporting one end of a scaffold plank outside of a building window opening, comprising in combination a strong, rigid member formed with a hook at one end for hooking over a window ledge and a loop at its opposite end for said plank to fit therein, and a steadying cross brace across said member fitted with a bolt adjacent each end thereof for abutting against a building wall to securely space the rigid member from the wall, one of said bolts being located along said cross brace at a greater distance from said rigid member than the other bolt, such that a rotational threading of said one bolt causes less movement of said rigid member than rotational threading of said other bolt, whereby said one bolt provides for fine adjustment and said other bolt provide for course adjustment.

2. A sky hook as in claim 1, and comprising rivet means for coupling said cross brace to said rigid member, and aligned openings in said cross brace and said rigid member for receiving said rivets, said openings being larger than said rivets to permit a loose fit of the rivets in the openings, and the rivets being of sufficient length to permit slight rotational movement of the cross brace with respect to the rigid member, to accommodate irregularities in the building wall surface against which the sky hook is installed.

* * * * *